United States Patent [19]

Plifka

[11] 4,419,872

[45] Dec. 13, 1983

[54] LOCKING DEVICE FOR SKIERS USE

[76] Inventor: John W. Plifka, 5412 - 26th Ave. South, Minneapolis, Minn. 55417

[21] Appl. No.: 284,354

[22] Filed: Jul. 17, 1981

[51] Int. Cl.[3] ..... E05B 63/06; E05B 65/00; E05B 73/00; A45C 13/18; E21B 19/14; B25B 5/02

[52] U.S. Cl. ..... 70/18; 70/57; 70/461; 206/1.5; 206/315.1; 211/4; 211/605 K; 224/917; 280/814; 294/147

[58] Field of Search ..... 70/18, 19, 57–59, 70/26, 62, 461; 280/814, 820; 294/147; 211/4, 60 SK; 248/507, 509; 403/4, 108; 224/917; 206/315, 1.5; 269/208, 906

[56] References Cited

U.S. PATENT DOCUMENTS

| | | | |
|---|---|---|---|
| D. 232,416 | 8/1974 | Gazda | 70/18 X |
| 1,218,013 | 3/1917 | Sturr | 70/18 |
| 3,754,420 | 8/1973 | Oellerich | 70/18 X |
| 3,805,564 | 4/1974 | Velardo | 70/18 |
| 3,924,426 | 12/1975 | Zane et al. | 70/18 |
| 3,999,409 | 12/1976 | Bell | 70/58 |
| 4,059,209 | 11/1977 | Grisel | 70/58 X |
| 4,216,665 | 8/1980 | McKelvey | 70/58 |
| 4,326,747 | 4/1982 | Finnegan | 70/58 X |

FOREIGN PATENT DOCUMENTS

| | | | |
|---|---|---|---|
| 271447 | 3/1964 | Australia | 248/220.4 |
| 2639273 | 3/1978 | Fed. Rep. of Germany | 280/814 |
| 1350086 | 4/1974 | United Kingdom | 70/58 |

*Primary Examiner*—Gary L. Smith
*Assistant Examiner*—Lloyd A. Gall
*Attorney, Agent, or Firm*—Orrin M. Haugen; Thomas J. Nikolai

[57] ABSTRACT

A ski lock comprising a U-shaped bracket having two generally parallel legs joined and spaced at first ends by a base strap, the free ends of the legs having pairs of aligned cruciform apertures at different spacings from the base, and a removable cross bolt having a rectangular body to be received in the apertures and a head to prevent the bolt from passing entirely through the apertures, and being configured to receive a lock for preventing removal of the bolt from the bracket.

4 Claims, 3 Drawing Figures

LOCKING DEVICE FOR SKIERS USE

TECHNICAL FIELD

This invention relates to locking devices and more particularly to a lock for securing skis against theft when left unattended.

BACKGROUND OF THE INVENTION

Between ski runs at various resorts it is not uncommon for a skier to remove his skis from time to time so that he can have refreshment or simply relax. Ski racks are usually provided for use by skiers to store their skis temporarily.

It is not uncommon for a skier to take another's skis from a rack by inadvertence, thinking them to be his own. More serious, however, is the intentional theft of skis which is becoming increasingly common with the increase in popularity of the short.

BRIEF SUMMARY OF THE INVENTION

The present invention comprises a locking device for skiers which is readily portable and conveniently used to secure skis and poles to a tree or rack in such fashion that they cannot readily be removed either intentionally or inadvertently. The device comprises a U-shaped bracket and a cross bolt removable from the bracket and replaceable in a plurality of mutually orthogonal orientations in pairs of shaped apertures in the bracket to define spaces of selectable sizes for receiving cross-county or down hill skis and poles of different dimensions, so that the device is of general utility, in cooperation with a lock or locking cable, to prevent unauthorized removal of the equipment.

Various advantages and features of novelty which characterize the invention are pointed out with particularity in the claims annexed herto and forming a part hereof. However, for a better understanding of the invention, its advantages, and objects obtained by it's use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals indicate corresponding parts throughout the several views.

DESCRIPTION OF THE PREFERRED EMBODIMENT

Figure 1:
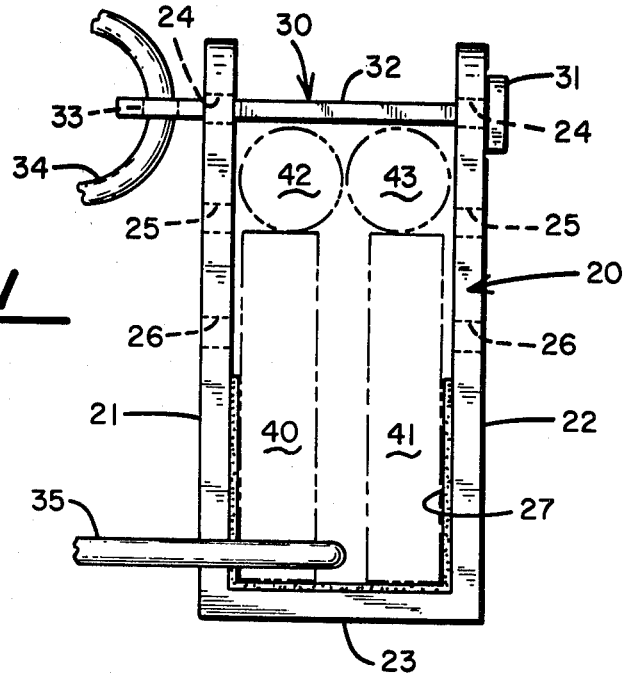
FIG. 1 is an end view of a ski lock according to the invention, in use.
Figure 2:
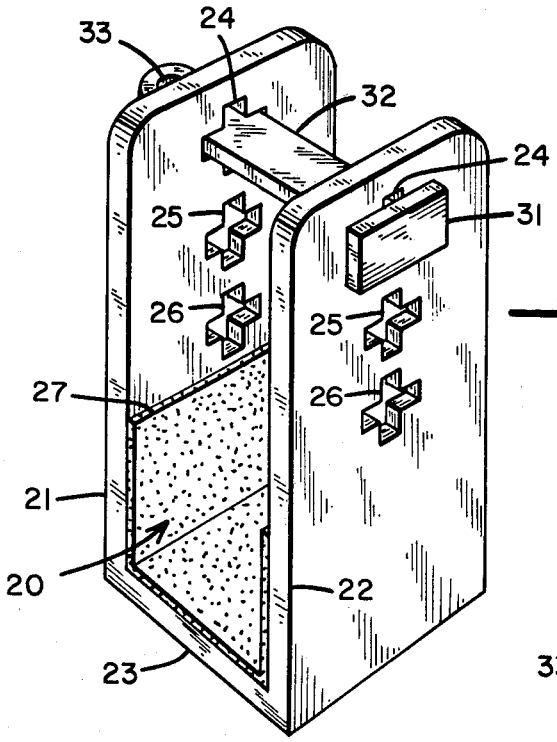
FIG. 2 is a view in perspective of the invention, and on FIG. 3 is a similar view of a cross bolt used in the invention.
Figure 3:
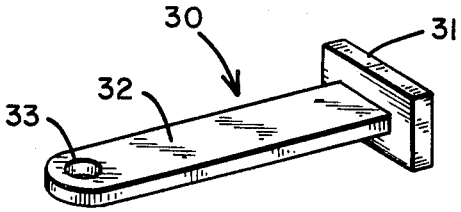

FIGS. 1 and 2 show that the invention comprises a U-shaped bracket 20 having two generally parallel legs 21 and 22 joined and spaced at first ends by a base strap 23. The legs have a plurality of pairs of apertures 24—24 25—25 and 26—26, at different spacings from strap 23, which are preferably cruciform with branches parallel and orthogonal to strap 23. The inner surfaces of strap 23 and legs 21 and 22 are preferably provided with a protective layer or coating 27 of rubber or other suitable plastic, secured thereto in any suitable fashion, and by adhesive.

A cross bolt 30 cooperates with bracket 20, and has a head 31 and a body 32. The body is of rectanguler cross section, to be received in apertures 24–26 in either of two mutually orthogonal orientations, and includes an aperture 33 for receiving a padlock or a locking cable 34 to prevent bolt 30 from being removed from bracket 20.

OPERATION

FIG. 1 shows the invention in use to receive a pair of skis 40, 41 and ski poles 42, 43. It is commonly known that cross-country skis are of different width than down hill-skis, and the apertures in the legs are positioned accordingly. Thus when bolt 30 is in apertures 26—26 a space is defined suitable to receive cross-country skis. When the bolt is in apertures 25—25 it defines a space suitable for down-hill skis or cross-country skis with poles, and when in aperture 24—24 the space is suitable for down hill skis with poles.

The skis are placed in bottom-to-bottom position and compressed together until they can be inserted into the bracket, at the site of the ski bindings. The poles are then positioned with the baskets at opposite ends and are placed on top of the skis. Cross bolt 30 is then inserted into the bracket, the choice of aperture pairs and the vertical/horizontal orientation of the bolt within the cruciform apertures being such as to securely hold the skiing equipment, longitudinal removement of the skis being prevented by the bindings, and longitudinal removement of the poles being prevented by the enlarged handles and the baskets at opposite ends. A locking cable is now passed through aperture 33 and secured about a suitable fixed boy such as a rack or tree. For added security a padlock may be passed through aperture 33 and a separate lock and cable 35 may be passed between the skis and secured to the fixed body.

For maximum strength, bracket 20 and bolt 30 should be of steel, but lightness and portability are better served if other materials such as aluminum or plastic are resorted to.

From the foregoing it will evident that I have invented a locking device for skiers' use which is readily portable and convenient, and gives security against loss of skis and poles while unattended.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principal of the invention, to the full extent indicated by the broad general meaning of the terms in which the appended claims are expressed.

I claim:

1. A ski lock comprising, in combination:

a U-shaped bracket having two generally parallel legs joined and spaced at first ends by a base strap, the free ends of said legs having pairs of aligned cruciform apertures at different spacings from said base strap;

and a removable cross bolt having a generally flat body exhibiting a rectangular cross-section dimensioned to be received in said cruciformed apertures in one of two mutually orthogonal orientations and a head to prevent passages of said bolt entirely through said apertures, the location of said pairs of apertures being such that the spacing between said bolt and said base strap corresponds to at least two different widths for different types of skis and skis with poles.

2. A ski lock according to claim 1, and a liner of protective material secure to the inner surfaces of said base and said legs.

3. A ski lock comprising, in combination:

a U-shaped bracket having two generally parallel legs joined and spaced at first ends by a base strap, the free ends of said legs having at least one pair of cruciform shaped, aligned apertures; and a removable cross bolt having a body exhibiting a non-circular cross-section and shaped to be received in said apertures in either of two orientations disposed substantially 90° relative to one another and a head for preventing passage of said bolt entirely through said apertures.

4. A lock according to claim 3 and a liner of protective material secure to the inner surfaces of said base and said legs.

* * * * *